US005261136A

United States Patent [19]

Hall

[11] Patent Number: 5,261,136

[45] Date of Patent: Nov. 16, 1993

[54] PISTOL TOOL

[76] Inventor: Stacy E. Hall, 3406 Newton Rd., Albany, Ga. 31707

[21] Appl. No.: 988,861

[22] Filed: Dec. 10, 1992

[51] Int. Cl.[5] ..... B25B 15/00

[52] U.S. Cl. ..... 7/165; 7/169; 42/90

[58] Field of Search ..... 7/165, 169, 170; 42/90, 42/106

[56] References Cited

U.S. PATENT DOCUMENTS 4,037,275 7/1977 Schor ..... 7/165 X 4,819,289 4/1989 Gibbs ..... 7/165 X

*Primary Examiner*—James G. Smith

*Attorney, Agent, or Firm*—Leon Gilden

[57] ABSTRACT

A pistol tool is formed of a unitary construction having a continuous side wall orthogonally oriented relative to a bottom wall, with the side wall having a first side wall portion and a second side wall portion arranged in a parallel relationship relative to an opposed side of a through-extending central bore. The second side wall includes a first bore whose axis is displaced relative to the second side wall and parallel relative to the central bore. A screw driver member projects from the first side wall portion for removal of pistol grips relative to a pistol member, wherein the second side wall bore is arranged for compression of a main spring portion of a pistol, with the central bore arranged for receiving a magazine follower button for depressing the magazine spring of an associated pistol magazine.

4 Claims, 4 Drawing Sheets

PISTOL TOOL

BACKGROUND OF THE INVENTION

1. Field of the Invention

The field of invention relates to pistol tool structure, and more particularly pertains to a new and improved pistol tool wherein the same is arranged for the ease of disassembly and maintenance of a pistol.

2. Description of the Prior Art

Prior art pistol structure, such as screw drivers and the like, are exemplified in the U.S. Pat. Nos. 4,827,812; 4,831,761; 4,819,289; and 4,766,800.

The instant invention attempts to address deficiencies of the prior art by providing for a tool specifically directed to the maintenance and disassembly of small bore pistols and in this respect, the present invention substantially fulfills this need.

SUMMARY OF THE INVENTION

In view of the foregoing disadvantages inherent in the known types of pistol tool apparatus now present in the prior art, the present invention provides a pistol tool wherein the same is arranged to provide for a tool for the ease of gun disassembly. As such, the general purpose of the present invention, which will be described subsequently in greater detail, is to provide a new and improved pistol tool which has all the advantages of the prior art pistol tool apparatus and none of the disadvantages.

To attain this, the present invention provides a pistol tool formed of a unitary construction having a continuous side wall orthogonally oriented relative to a bottom wall, with the side wall having a first side wall portion and a second side wall portion arranged in a parallel relationship relative to an opposed side of a through-extending central bore. The second side wall includes a first bore whose axis is displaced relative to the second side wall and parallel relative to the central bore. A screw driver member projects from the first side wall portion for removal of pistol grips relative to a pistol member, wherein the second side wall bore is arranged for compression of a portion of a pistol, with the central bore arranged for receiving a magazine follower button for depressing the magazine spring of an associated pistol magazine.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pistol tool which has all the advantages of the prior art pistol tool apparatus and none of the disadvantages.

It is another object of the present invention to provide a new and improved pistol tool which may be easily and efficiently manufactured and marketed.

It is a further object of the present invention to provide a new and improved pistol tool which is of a durable and reliable construction.

An even further object of the present invention is to provide a new and improved pistol tool which is susceptible of a low cost of manufacture with regard to both materials and labor, and which accordingly is then susceptible of low prices of sale to the consuming public, thereby making such pistol tools economically available to the buying public.

Still yet another object of the present invention is to provide a new and improved pistol tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
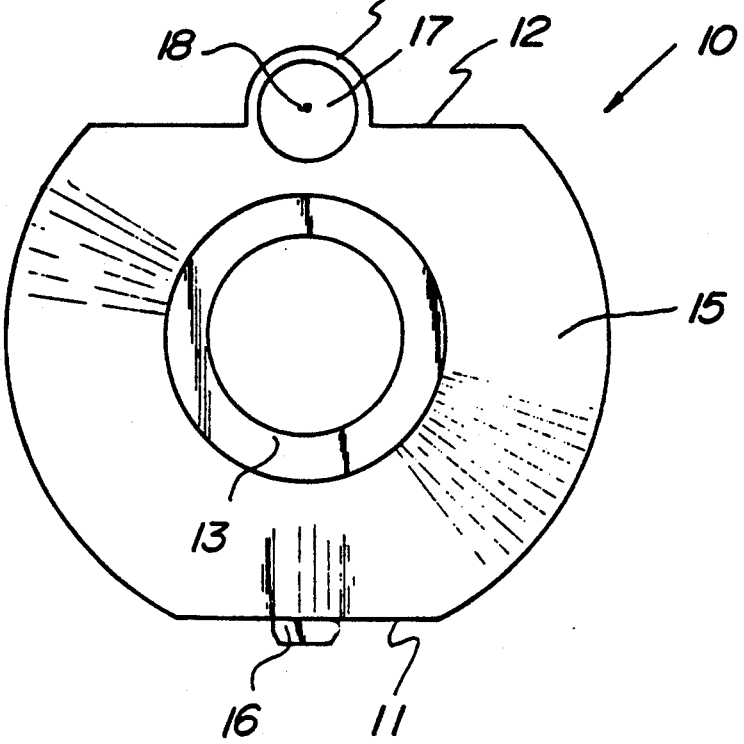
FIG. 1 is an orthographic top view of the tool structure of the invention.
Figure 2:
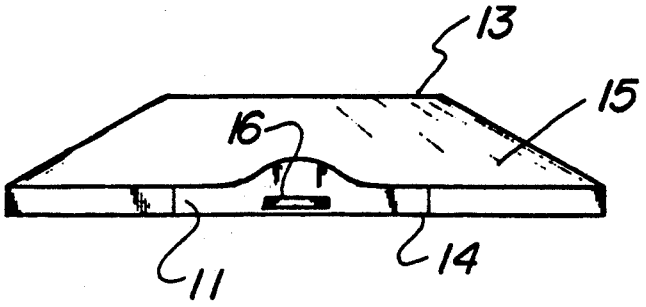
FIG. 2 is an orthographic side view of the tool structure.
Figure 3:
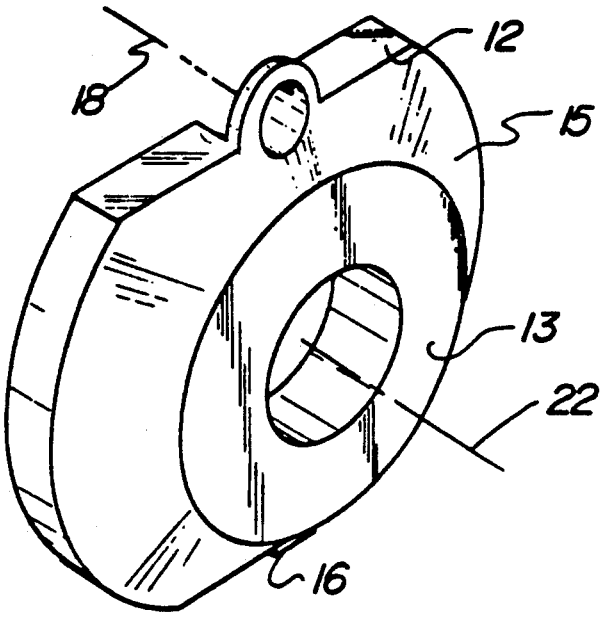
FIG. 3 is an isometric top view of the instant invention.
Figure 4:
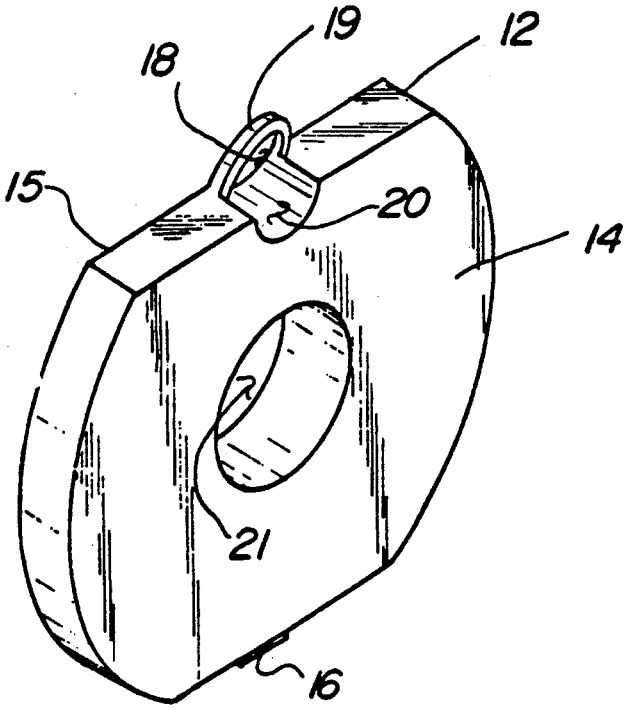
FIG. 4 is an isometric bottom view of the invention.

With reference now to the drawings, and in particular to FIGS. 1 to 8 thereof, a new and improved pistol tool embodying the principles and concepts of the present invention and generally designated by the reference numeral 10 will be described.

More specifically, the pistol tool 10 of the instant invention essentially comprises a unitary rigid member having a continuous side wall that is orthogonally oriented relative to a planar bottom wall 14 intersecting the planar bottom wall and orthogonally oriented relative to a planar top wall 13 of a circular configuration and spaced from the planar top wall. The continuous side wall includes a planar first side wall portion 11 parallel to and spaced from a second side wall portion 12 on opposed sides of the tool 10. A truncated conical transition wall 15 extends from the planar top wall 14 to the continuous side wall to provide for clearance and access of the top wall 13 for mounting upon a magazine follower button 24 of an associated magazine 23, in a manner as indicated in the FIGS. 5 and 6.

Figure 7:
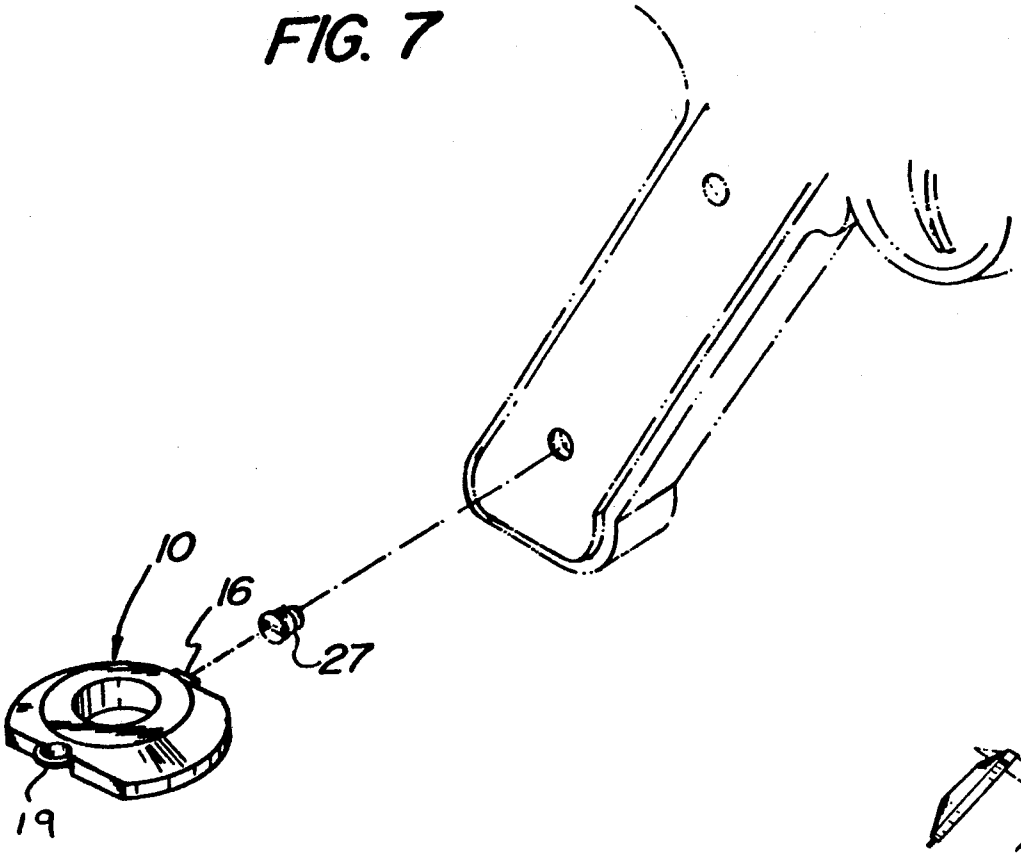
FIG. 7 is an isometric illustration of the tool for dismounting pistol grip portions of the associated pistol.

A screw driver blade 16 is mounted medially and orthogonally relative to the planar first side wall portion 11 for removal of pistol grip screws 27 relative to an associated pistol, in a manner as indicated in the FIG. 7.

A semi-cylindrical hoop 19 is mounted medially of the second side wall portion 12 coplanar with the transition wall 15. The semi-cylindrical hoop 19 defines a cylindrical first bore 17 therethrough having a first bore axis 18 arranged parallel relative to the second side wall portion 12 and spaced therefrom exteriorly of the tool 10. The cylindrical first bore 17 is coaxially aligned with a semi-cylindrical recess 20 directed into the second side wall portion, wherein the cylindrical first bore 17 and the semi-cylindrical recess 20 are each of a first diameter to receive a main spring housing latch "H" therethrough in the compression of a pistol main spring housing latch "H".

Figure 5:
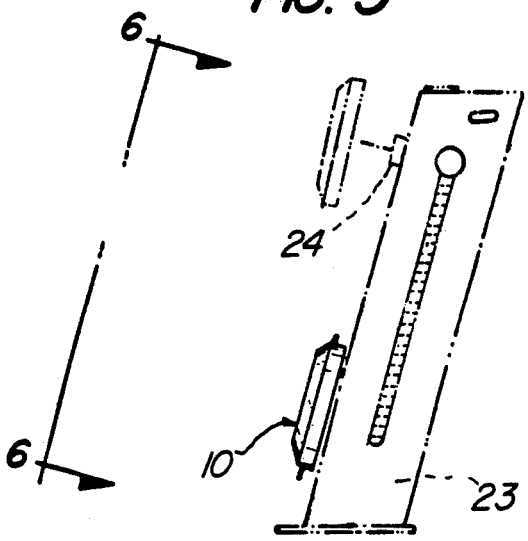
FIG. 5 is an orthographic side view of the invention utilized for the compression of a magazine spring.
Figure 6:
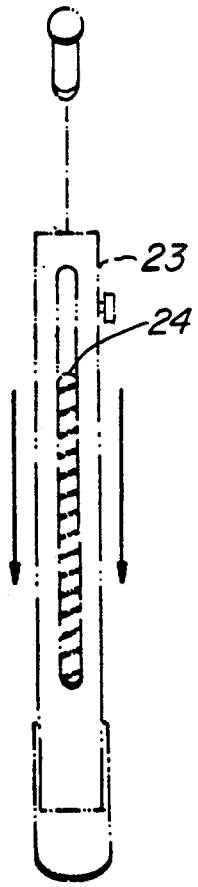
FIG. 6 is an orthographic end view, taken along the lines 6—6 of FIG. 5 illustrating the magazine spring follower button relative to the associated magazine spring.
Figure 8:
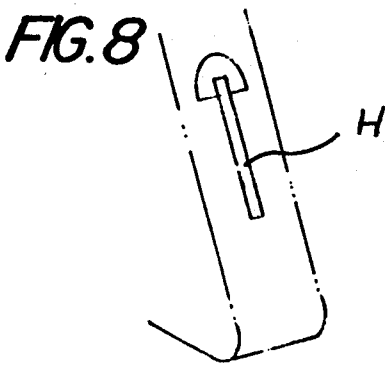
FIG. 8 is an orthographic rear view in use of a pistol housing latch.
Figure 9:
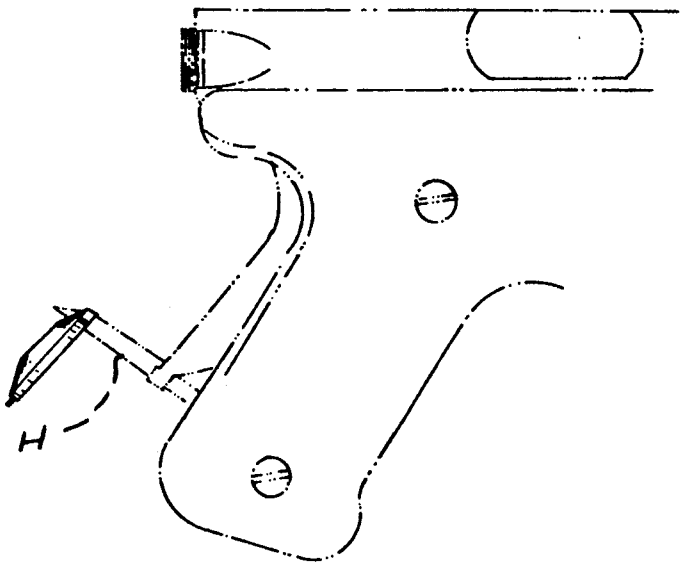
FIG. 9 is an orthographic side view of the tool in use in displacing the housing latch relative to the pistol.

A second bore 21 is directed orthogonally through the tool 10 extending from the top wall 13 to the bottom wall 14, having a second bore axis 22 oriented parallel relative to the first bore axis to permit mounting of the tool bottom wall against a rear side wall of an associated magazine 23 to receive the magazine follower button 24 within the second bore. As illustrated in FIG. 5, the button 24 may be oriented on a side or end wall of the associated magazine 23. In this manner, downward projection of the magazine follower button permits loading of the associated magazine in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pistol tool, comprising, a unitary rigid member, wherein the member includes a planar bottom wall spaced from and parallel a planar top wall, and a continuous side wall orthogonally oriented relative to the planar top wall and to the bottom wall intersecting the bottom wall, with the continuous side wall having a planar first side wall portion spaced from a planar second side wall portion, the first side wall portion includes a screw driver blade orthogonally and integrally mounted medially of the first side wall portion, and the second side wall portion includes a semi-cylindrical hoop integrally mounted medially of the second side wall portion, with a cylindrical first bore directed through the hoop, and a second bore directed through the member extending from the top wall through the bottom wall.

2. A pistol tool as set forth in claim 1 wherein the first bore is oriented about a first bore axis, and the second bore is oriented about a second bore axis, wherein the first bore axis is parallel relative to the second bore axis, and the first bore axis is oriented parallel to and in a spaced relationship exteriorly of the second side wall portion.

3. A pistol tool as set forth in claim 2 wherein the second side wall portion includes a semi-cylindrical recess, with the semi-cylindrical recess and the first bore defined by a first diameter, and the semi-cylindrical recess coaxially aligned with the first bore axis, the second bore having a second bore diameter substantially greater than the first bore diameter.

4. A pistol tool as set forth in claim 3 wherein a conical transition wall extends from the side wall and the top wall, and wherein the semi-cylindrical wall is coplanar with the transition wall to afford clearance in securing a housing latch of a pistol in a disassembly procedure.

* * * * *